US011284190B2

(12) United States Patent
Hou

(10) Patent No.: US 11,284,190 B2
(45) Date of Patent: Mar. 22, 2022

(54) METHOD AND DEVICE FOR PROCESSING AUDIO SIGNAL WITH FREQUENCY-DOMAIN ESTIMATION, AND NON-TRANSITORY COMPUTER-READABLE STORAGE MEDIUM

(71) Applicant: BEIJING XIAOMI INTELLIGENT TECHNOLOGY CO., LTD., Beijing (CN)

(72) Inventor: Haining Hou, Beijing (CN)

(73) Assignee: Beijing Xiaomi Intelligent Technology Co., Ltd., Beijing (CN)

( * ) Notice: Subject to any disclaimer, the term of this patent is extended or adjusted under 35 U.S.C. 154(b) by 0 days.

(21) Appl. No.: 16/885,230

(22) Filed: May 27, 2020

(65) Prior Publication Data

US 2021/0185438 A1 Jun. 17, 2021

(30) Foreign Application Priority Data

Dec. 17, 2019 (CN) ..... 201911301727.2

(51) Int. Cl.
*H04R 3/00* (2006.01)
*H04R 3/04* (2006.01)

(52) U.S. Cl.
CPC ..... *H04R 3/005* (2013.01); *H04R 3/04* (2013.01)

(58) Field of Classification Search
None
See application file for complete search history.

(56) References Cited

U.S. PATENT DOCUMENTS

2007/0025556 A1 2/2007 Hiekata
2011/0231185 A1 9/2011 Kleffner et al.
(Continued)

FOREIGN PATENT DOCUMENTS

CN 1855227 A 11/2006
CN 102890936 A 1/2013
CN 106405501 A 2/2017
(Continued)

OTHER PUBLICATIONS

Extended European Search Report in the European application No. 20180826.8, dated Nov. 23, 2020, (8p).
(Continued)

*Primary Examiner* — James K Mooney
(74) *Attorney, Agent, or Firm* — Arch & Lake LLP

(57) ABSTRACT

A method for processing an audio signal is provided. In the method, audio signals sent by at least two sound sources are acquired by at least two microphones to obtain multiple frames of original noisy signals of each microphone on a time domain. For each frame, frequency-domain estimation signals of each sound source are acquired according to the original noisy signals of the at least two microphones. For each sound source, the frequency-domain estimation signals are divided into multiple frequency-domain estimation components on a frequency domain. For each sound source, feature decomposition is performed on a related matrix of each frequency-domain estimation component to obtain a target feature vector. A separation matrix of each frequency point is obtained based on target feature vectors and the frequency-domain estimation signals. The audio signals of sounds are obtained based on the separation matrixes and the original noisy signals.

14 Claims, 3 Drawing Sheets

(56) References Cited

U.S. PATENT DOCUMENTS

| | | | |
|---|---|---|---|
| 2018/0286423 | A1 | 10/2018 | Nakadai et al. |
| 2018/0366135 | A1 | 12/2018 | Nakatani et al. |

FOREIGN PATENT DOCUMENTS

| | | | |
|---|---|---|---|
| EP | 3392882 | A1 | 10/2018 |
| JP | 2013054258 | A | 3/2013 |
| WO | 2014079484 | A1 | 5/2014 |

OTHER PUBLICATIONS

First Office Action of the Chinese Application No. 201911301727.2, dated Dec. 28, 2021, with English translation, (13p).

METHOD AND DEVICE FOR PROCESSING AUDIO SIGNAL WITH FREQUENCY-DOMAIN ESTIMATION, AND NON-TRANSITORY COMPUTER-READABLE STORAGE MEDIUM

CROSS-REFERENCE TO RELATED APPLICATIONS

This application claims priority to Chinese Patent Application No. CN201911301727.2, filed on Dec. 17, 2019, the entire content of which is incorporated herein by reference for all purposes.

BACKGROUND

An intelligent product device can adopt a microphone array for pickup voices, and a microphone-based beamforming technology may be adopted to improve voice signal processing quality to increase a voice recognition rate in a real environment. However, a multi-microphone-based beamforming technology is sensitive to a position error of the microphones, resulting in great influence on performance. In addition, an increase in the number of microphones may also increase product cost.

SUMMARY

The present disclosure provides a method, a device, a non-transitory computer-readable storage medium for processing an audio signal.

According to a first aspect of the present disclosure, a method for processing an audio signal is provided. The method may include: acquiring, through at least two microphones of a terminal, audio signals sent by at least two sound sources, to obtain a plurality of frames of original noisy signals of each of the at least two microphones on a time domain; for each frame of the original noisy signals on the time domain, acquiring frequency-domain estimation signals of each of the at least two sound sources according to the original noisy signals of the at least two microphones; for each of the at least two sound sources, dividing the frequency-domain estimation signals into a plurality of frequency-domain estimation components based on a frequency domain, where each frequency-domain estimation component may correspond to a frequency-domain sub-band and may comprise a plurality of pieces of frequency point data.

The method may also include: for each of the at least two sound sources, performing feature decomposition on a related matrix of each of the frequency-domain estimation components to obtain a target feature vector corresponding to the frequency-domain estimation component; for each of the at least two sound sources, obtaining a separation matrix of each of frequency points based on target feature vectors and the frequency-domain estimation signals of the sound source; and obtaining the audio signals of sounds produced by the at least two sound sources based on separation matrixes and the original noisy signals.

According to a second aspect the present disclosure, a device for processing an audio signal is provided. The device may include a processor; and a memory configured to store instructions executable by the processor.

The processor may be configured to: acquire, through at least two microphones, audio signals sent by at least two sound sources, to obtain a plurality of frames of original noisy signals of each of the at least two microphones on a time domain; for each frame of the original noisy signals on the time domain, acquire frequency-domain estimation signals of each of the at least two sound sources according to the original noisy signals of the at least two microphones; for each of the at least two sound sources, divide the frequency-domain estimation signals into a plurality of frequency-domain estimation components based on a frequency domain, where each frequency-domain estimation component may correspond to a frequency-domain sub-band and may comprise a plurality of pieces of frequency point data.

The processor may also be configured to: for each of the at least two sound sources, perform feature decomposition on a related matrix of each of the frequency-domain estimation components to obtain a target feature vector corresponding to the frequency-domain estimation component; for each of the at least two sound sources, obtain a separation matrix of each of frequency points based on target feature vectors and the frequency-domain estimation signals of the sound source; and obtain the audio signals of sounds produced by the at least two sound sources based on separation matrixes and the original noisy signals.

According to a third aspect of the present disclosure, a non-transitory computer-readable storage medium is provided. The non-transitory computer-readable storage medium stores an executable program.

The executable program may be executed by a processor to implement: acquiring, through at least two microphones, audio signals sent by at least two sound sources, to obtain a plurality of frames of original noisy signals of each of the at least two microphones on a time domain; for each frame of the original noisy signals on the time domain, acquiring frequency-domain estimation signals of each of the at least two sound sources according to the original noisy signals of the at least two microphones; for each of the at least two sound sources, dividing the frequency-domain estimation signals into a plurality of frequency-domain estimation components based on a frequency domain, where each frequency-domain estimation component may correspond to a frequency-domain sub-band and may comprise a plurality of pieces of frequency point data.

The executable program may be executed by the processor to further implement: for each of the at least two sound sources, performing feature decomposition on a related matrix of each of the frequency-domain estimation components to obtain a target feature vector corresponding to the frequency-domain estimation component; for each of the at least two sound sources, obtaining a separation matrix of each of frequency points based on target feature vectors and the frequency-domain estimation signals of the sound source; and obtaining the audio signals of sounds produced by the at least two sound sources based on separation matrixes and the original noisy signals.

It is to be understood that the above general descriptions and the following detailed descriptions are only exemplary and explanatory, rather than limiting the present disclosure.

BRIEF DESCRIPTION OF THE DRAWINGS

The accompanying drawings, which are incorporated in and constitute a part of this specification, illustrate examples consistent with the present disclosure and, along with the description, serve to explain the principles of the present disclosure.

DETAILED DESCRIPTION

Reference are made in detail to examples, examples of which are illustrated in the accompanying drawings. The following description refers to the accompanying drawings in which the same numbers in different drawings represent the same or similar elements unless otherwise represented. The implementations set forth in the following description of examples do not represent all implementations consistent with the present disclosure. Instead, they are merely examples of devices and methods consistent with aspects related to the present disclosure.

The terminology used in the present disclosure is for the purpose of describing exemplary examples only and is not intended to limit the present disclosure. As used in the present disclosure and the appended claims, the singular forms "a," "an" and "the" are intended to include the plural forms as well, unless the context clearly indicates otherwise. It shall also be understood that the terms "or" and "and/or" used herein are intended to signify and include any or all possible combinations of one or more of the associated listed items, unless the context clearly indicates otherwise.

It shall be understood that, although the terms "first," "second," "third," and the like may be used herein to describe various information, the information should not be limited by these terms. These terms are only used to distinguish one category of information from another. For example, without departing from the scope of the present disclosure, first information may be termed as second information; and similarly, second information may also be termed as first information. As used herein, the term "if" may be understood to mean "when" or "upon" or "in response to" depending on the context.

A multi-microphone-based beamforming technology applied in intelligent product devices for picking up voices may be sensitive to a position error of the microphones, resulting in great influence on performance. Also, an increase in the number of microphones may also increase the cost of making the product. Thus, more and more intelligent product devices are configured with two microphones. The two microphones usually adopt a blind source separation technology different from the multi-microphone-based beamforming technology for voice enhancement. How to obtain high voice quality of a signal separated based on the blind source separation technology is a problem that needs to be solved.

Figure 1:
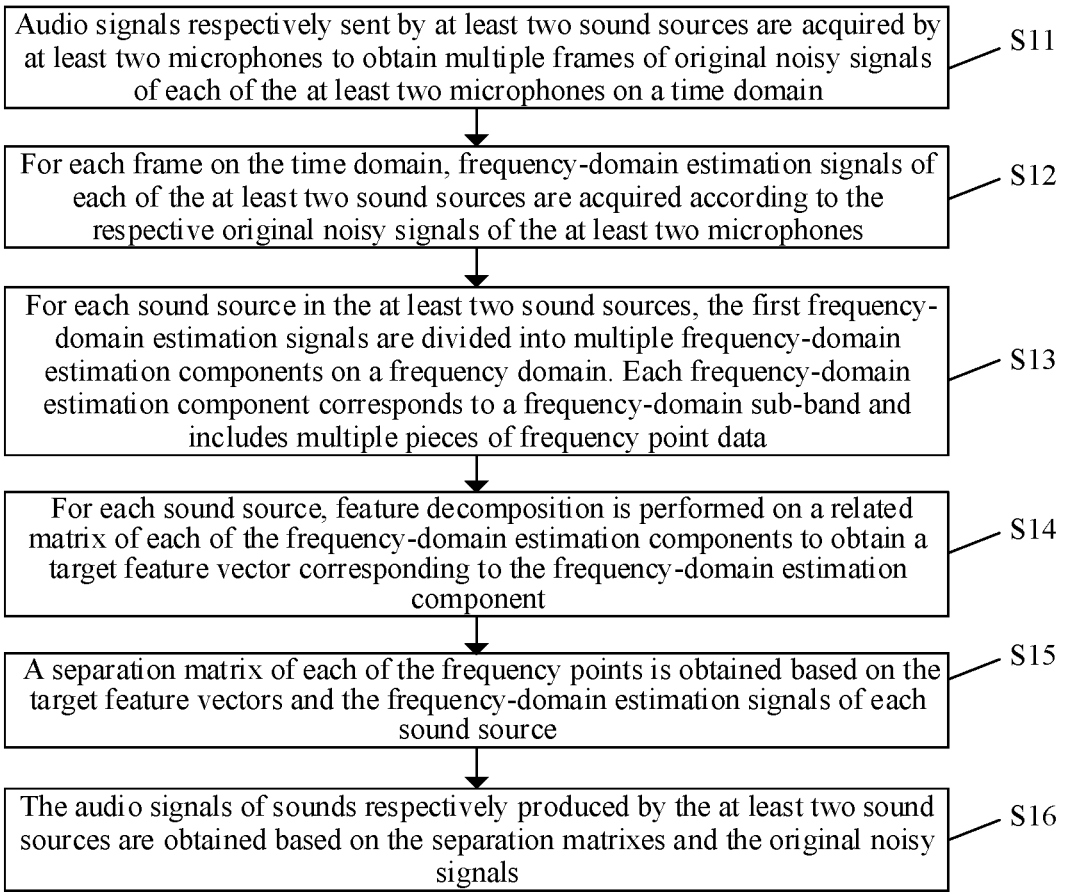
FIG. 1 is a flow chart of a method for processing an audio signal according to an example.

FIG. 1 is a flow chart of a method for processing an audio signal according to an example. As shown in FIG. 1, the method includes the following operations.

In S11, audio signals respectively sent by at least two sound sources are acquired by at least two microphones to obtain multiple frames of original noisy signals of each of the at least two microphones on a time domain. The time domain may be a time period for a frame of audio signals that include noises from each of the microphones. The original noisy signals may be audio signals including noises that can be collected via a microphone.

In S12, for each frame on the time domain, frequency-domain estimation signals of each of the at least two sound sources are acquired according to the respective original noisy signals of the at least two microphones.

In S13, for each sound source in the at least two sound sources, the frequency-domain estimation signals are divided into multiple frequency-domain estimation components on a frequency domain. The frequency domain may be a frequency range for the frequency-domain estimate component. Each frequency-domain estimation component corresponds to a frequency-domain sub-band and includes multiple pieces of frequency point data.

In S14, for each sound source, feature decomposition is performed on a related matrix of each of the frequency-domain estimation components to obtain a target feature vector corresponding to the frequency-domain estimation component.

In S15, a separation matrix of each of the frequency points is obtained based on the target feature vectors and the frequency-domain estimation signals of each sound source.

In S16, the audio signals of sounds respectively produced by the at least two sound sources are obtained based on the separation matrixes and the original noisy signals.

The technical solutions provided by examples of the present disclosure may have the following beneficial effects.

In the examples of the present disclosure, the respective frequency-domain estimation components of the at least two sound sources may be obtained based on the acquired multiple frames of original noisy signals, feature separation is performed on the related matrixes of the frequency-domain estimation components to obtain the target feature vectors, and furthermore, a separation matrix of each frequency point is obtained based on the target feature vectors. The separation matrix obtained in the examples of the present disclosure is determined based on the target feature vectors decomposed from the related matrixes of the frequency-domain estimation components in different frequency-domain sub-bands. Therefore, according to the examples of the present disclosure, signals may be decomposed based on subspaces corresponding to the target feature vectors, thereby suppressing a noise signal in each original noisy signal, and improving quality of the separated audio signal.

In addition, compared with the other implementations that signals of sound sources are separated by using the multi-microphone-based beamforming technology, the method for processing an audio signal in the example of the present disclosure can obtain accurate separation for audio signals of sounds produced by the sound sources without considering positions of these microphones.

The method of the example of the present disclosure is applied to a terminal. Herein, the terminal is an electronic device integrated with two or more than two microphones. For example, the terminal may be an on-vehicle terminal, a computer or a server. In an example, the terminal may also be an electronic device connected with a predetermined device integrated with two or more than two microphones, and the electronic device receives an audio signal acquired by the predetermined device based on the connection and sends the processed audio signal to the predetermined device based on the connection. For example, the predetermined device is a speaker.

During a practical application, the terminal includes at least two microphones, and the at least two microphones simultaneously detect the audio signals sent respectively by the at least two sound sources, to obtain the respective original noisy signals of the at least two microphones.

Herein, it can be understood that, in the example, the at least two microphones synchronously detect the audio signals sent by the two sound sources.

According to the method for processing an audio signal of the example of the present disclosure, audio signals of audio frames in a predetermined time are separated after original noisy signals of the audio frames in the predetermined time are acquired.

In the example of the present disclosure, the microphones include two or more than two microphones, and the sound sources include two or more than two sound sources.

In the example of the present disclosure, the original noisy signal is a mixed signal of sounds produced by the at least two sound sources.

For example, two microphones, i.e., a microphone 1 and a microphone 2 are included, and two sound sources, i.e., a sound source 1 and a sound source 2 are included. In such case, the original noisy signal of the microphone 1 includes audio signals of the sound source 1 and the sound source 2, and the original noisy signal of the microphone 2 also includes audio signals of the sound source 1 and the sound source 2.

For example, three microphones, i.e., a microphone 1, a microphone 2 and a microphone 3 are included, and three sound sources, i.e., a sound source 1, a sound source 2 and a sound source 3 are included. In such case, the original noisy signal of the microphone 1 includes audio signals of the sound source 1, the sound source 2 and the sound source 3, and the original noisy signal of each of the microphone 2 and the microphone 3 also includes audio signals of the sound source 1, the sound source 2 and the sound source 3.

It can be understood that, if a signal of a sound produced by a sound source is an audio signal in a microphone, a signal of other sound source in the microphone is a noise signal. According to the example of the present disclosure, the audio signals produced by the at least two sound sources are recovered from the at least two microphones.

It can be understood that the number of the sound sources is usually the same as the number of the microphones. In some examples, if the number of the microphones is smaller than the number of the sound sources, a dimension of the number of the sound sources may be reduced to a dimension equal to the number of the microphones.

In the example of the present disclosure, the frequency-domain estimation signals may be divided into at least two frequency-domain estimation components in at least two frequency-domain sub-bands. The number of the frequency-domain estimation signals in the frequency-domain estimation components in any two frequency-domain sub-bands may be the same with each other or different from each other.

Herein, the multiple frames of original noisy signals refer to original noisy signals of multiple audio frames. In an example, an audio frame may be an audio band with a preset time length.

For example, there are 100 frequency-domain estimation signals, and the frequency-domain estimation signals are divided into frequency-domain estimation components in three frequency-domain sub-bands. The frequency-domain estimation components of the first frequency-domain sub-band, the second frequency-domain sub-band and the third frequency-domain sub-band include 25, 35 and 40 frequency-domain estimation signals respectively. For another example, there are 100 frequency-domain estimation signals, and the frequency-domain estimation signals are divided into frequency-domain estimation components in four frequency-domain sub-bands, each of the frequency-domain estimation components in the four frequency-domain sub-bands includes 25 frequency-domain estimation signals.

In an example, S14 includes an operation as follows.

Feature decomposition is performed on a related matrix of the frequency-domain estimation component to obtain a maximum feature value.

A target feature vector corresponding to the maximum feature value is obtained based on the maximum feature value.

It can be understood that feature decomposition may be performed on one frequency-domain estimation component to obtain multiple feature values, and one feature vector may be obtained based on one feature value. Herein, one target feature vector corresponds to one subspace, and the subspaces corresponding to target feature vectors of the frequency-domain estimation components form a space. Herein, signal to noise ratios of the original noisy signal in different subspaces of the space are different. The signal to noise ratio refers to a ratio of the audio signal to the noise signal.

Herein, if the feature vector corresponding to the maximum feature value is the maximum target feature vector, the signal to noise ratio of the subspace corresponding to the maximum target feature vector is maximum.

In the example of the present disclosure, the respective frequency-domain estimation components of the at least two sound sources may be obtained based on the acquired multiple frames of original noisy signals, the frequency-domain estimation signals are divided into at least two frequency-domain estimation components in different frequency-domain sub-bands, feature separation is performed on the related matrix of the frequency-domain estimation component to obtain the target feature vector. Furthermore, the separation matrix of each frequency point is obtained based on the target feature vectors. In this way, the separation matrixes obtained in the example of the present disclosure are determined based on the target feature vectors decomposed from the related matrixes of the frequency-domain estimation components of different frequency-domain sub-bands. Therefore, according to the example of the present disclosure, signals may be decomposed based on subspaces corresponding to the target feature vectors, thereby suppressing a noise signal in each original noisy signal, and improving quality of the separated audio signal.

In addition, the separation matrix in the example of the present disclosure is determined based on the related matrix of the frequency-domain estimation component of each of the frequency-domain sub-bands. Compared with the separation matrix which is determined based on all the frequency-domain estimation signals of the whole band, the present disclosure takes into consideration that the frequency-domain estimation signals between the frequency-domain sub-bands have the same dependence without considering that all the frequency-domain estimation signals of the whole band have the same dependent, thereby having higher separation performance.

Moreover, compared with the other implementations that signals of sound sources are separated by use of a multi-microphone-based beamforming technology, the positions of the microphones are not considered in the method for processing an audio signal provided in the example of the present disclosure, thereby implementing high accurate separation for the audio signals of the sounds produced by the sound sources.

In addition, if the method for processing an audio signal is applied to a terminal device with two microphones, compared with the other implementations that voice quality is improved by use of a beamforming technology based on at least more than three microphones, the number of microphones can be greatly reduced in the method, thereby reducing hardware cost of the terminal.

Furthermore, in the example of the present disclosure, if feature decomposition is performed on the related matrix to obtain the maximum target feature vector corresponding to the maximum feature value, separating the original noisy signals by use of the separation matrix obtained based on the maximum target feature vector is implemented by separating the original noisy signals based on the subspace corresponding to the maximum signal to noise ratio, thereby further improving the separation performance, and improving the quality of the separated audio signal.

In an example, S11 includes an operation as follows.

The audio signals respectively sent by the at least two sound sources are simultaneously detected through at least two microphones to obtain each frame of original noisy signal respectively acquired by the at least two microphones on the time domain.

In some examples, S12 includes an operation as follows.

The original noisy signal on the time domain is converted into original noisy signal on the frequency domain, and the original noisy signal on the frequency domain is converted into the frequency-domain estimation signal.

Herein, frequency-domain transform may be performed on the time-domain signal based on Fast Fourier Transform (FFT). Alternatively, frequency-domain transform may be performed on the time-domain signal based on Short-Time Fourier Transform (STFT). Alternatively, frequency-domain transform may also be performed on the time-domain signal based on other Fourier transform.

For example, if the nth frame of time-domain signal of the Pth microphone is denoted as $x_p''(m)$, the nth frame of time-domain signal is converted into a frequency-domain signal, and the nth frame of original noisy signal is determined to be: $X_p$ (k,n)=STFT ($x_p''(m)$), where k denotes the frequency point, k=1, L, K, m denotes the number of discrete time points of the n th frame of time-domain signal, and m=1, L, Nfft. Therefore, according to the example, each frame of original noisy signal on the frequency domain may be obtained by conversion from the time domain to the frequency domain. Of course, each frame of original noisy signal may also be obtained based on another Fourier transform formula, which is not limited herein.

In some examples, the method further includes operations as follows.

For each sound source, a first matrix of the cth frequency-domain estimation component is obtained based on a product of the cth frequency-domain estimation component and a conjugate transpose of the cth frequency-domain estimation component.

The related matrix of the cth frequency-domain estimation component is acquired based on the first matrixes of the cth frequency-domain estimation components of the first frame to the Nth frame. N denotes the frame number of the original noisy signals, c is a positive integer less than or equal to C, and C denotes the number of the frequency-domain sub-bands.

For example, if the cth frequency-domain estimation component is denoted as $Y^c(n)$, the conjugate transpose of the cth frequency-domain estimation component of the pth sound source is denoted as $Y^c(n)^H$, the obtained first matrix of the cth frequency-domain estimation component is denoted as $\overline{Y}^c(n)\overline{Y}^c(n)^H$, and the obtained related matrix of the cth frequency-domain estimation component is denoted as $$\sum^{c} = \frac{1}{N}\sum_{n=1}^{N}\overline{Y}^c(n)\overline{Y}^c(n)^H,$$

where c denotes a positive integer less than or equal to C and C denotes the number of the frequency-domain sub-bands.

For another example, if the cth frequency-domain estimation component of the pth sound source is denoted as $Y_p^c(n)$, the conjugate transpose of the cth frequency-domain estimation component of the pth sound source is denoted as $Y^c(n)^H$, the obtained first matrix of the cth frequency-domain estimation component of the pth sound source is denoted as $\overline{Y}^c(n)\overline{Y}^c(n)^H$, and the obtained related matrix of the cth frequency-domain estimation component is denoted as $$\sum_{p}^{c} = \frac{1}{N}\sum_{n=1}^{N}\overline{Y}_p^c(n)\overline{Y}_p^c(n)^H,$$

where c is a positive integer less than or equal to C, C denotes the number of the frequency-domain sub-bands, p is a positive integer less than or equal to P and P is the number of the sound sources.

Accordingly, in the example of the present disclosure, the related matrix of the frequency-domain estimation component may be obtained based on the frequency-domain sub-band, and the separation matrix is obtained based on the related matrix. Therefore, the present disclosure takes into consideration that the frequency-domain estimation signals between the frequency-domain sub-bands have the same dependence without considering that all the frequency-domain estimation signals of the whole band have the same dependent, thereby having higher separation performance.

In some examples, S15 includes operations as follows.

For each sound source, mapping data of the cth frequency-domain estimation component mapped into a preset space is obtained based on a product of a transposed matrix of the target feature vector of the cth frequency-domain estimation component and the cth frequency-domain estimation component.

The separation matrixes are obtained based on the mapping data and iterative operations of the first frame to the Nth frames of original noisy signals.

Herein, the preset space is the subspace corresponding to the maximum target feature vector.

In an example, the maximum target feature vector is a target feature vector corresponding to the maximum feature value, and the preset space is the subspace corresponding to the target feature vector of the maximum feature value.

In an example, the operation that the mapping data of the cth frequency-domain estimation component mapped into the preset space is obtained based on the product of the transposed matrix of the target feature vector of the cth frequency-domain estimation component and the cth frequency-domain estimation component includes operations as follows.

Alternative, mapping data is obtained based on the product of the transposed matrix of the target feature vector of the cth frequency-domain estimation component and the cth frequency-domain estimation component.

The mapping data of the cth frequency-domain estimation component mapped into the preset space is obtained based on the alternative mapping data and a first numerical value. The first numerical value is a value obtained by rooting the feature value corresponding to the target feature vector.

For example, if feature decomposition is performed on the related matrix of the cth frequency-domain estimation component of the pth sound source to obtain the maximum feature value $\lambda_p^c$ and further obtain that the target feature vector corresponding to the maximum feature value as a maximum target feature vector $v_p^c$. The mapping data $q_p^c=\alpha(v_p^c)^T\bar{Y}_p^c(n)$ of the cth frequency-domain estimation component of the pth sound source is obtained, where $(v_p^c)^T$ denotes the transposed matrix of $v_p^c$, $\alpha$ is $\sqrt{\lambda_p^c}$, c is a positive integer less than or equal to C, C denotes the number of the frequency-domain sub-bands, p is a positive integer less than or equal to P and P denotes the number of the sound sources.

In the example of the present disclosure, the mapping data of a frequency-domain estimation component in the corresponding subspace may be obtained based on the product of the transposed matrix of the target feature vector of the frequency-domain estimation component and the frequency-domain estimation component, the mapping data may represent mapping data of the original noisy signal projected into the subspace. Furthermore, the mapping data of the maximum target feature vector projected into the corresponding subspace is obtained based on a product of a transposed matrix of the target feature vector corresponding to the maximum feature value of each frequency-domain estimation component and the frequency-domain estimation component In this way, the separation matrix obtained based on the mapping data has higher separation performance, thereby improving the quality of the separated audio signal.

In some examples, the method further includes an operation as follows.

Nonlinear transform is performed on the mapping data according to a logarithmic function to obtain updated mapping data.

Herein, the logarithmic function may be represented as $G(q)=\log_a(q)$, where q denotes the mapping data, G (q) denotes the updated mapping data, a denotes a base number of the logarithmic function, and a is 10 or e.

In the example of the present disclosure, nonlinear transform may be performed on the mapping data based on the logarithmic function, for estimating a signal entropy of the mapping data. In this way, the separation matrix obtained based on the updated mapping data has higher separation performance, thereby improving the voice quality of the acquired audio signal.

In some examples, the operation that the separation matrix is obtained based on the mapping data and the iterative operations of the first frame to the Nth frames of original noisy signals includes operations as follows.

Gradient iteration is performed based on the updated mapping data of the cth frequency-domain estimation component, the frequency-domain estimation signal, the original noisy signal and an (x−1)th alternative matrix, to obtain an xth alternative matrix. A first alternative matrix is a known identity matrix, and x is a positive integer more than or equal to 2.

In response to that the xth alternative matrix meets an iteration stopping condition, the cth separation matrix is determined based on the xth alternative matrix.

In the example of the present disclosure, gradient iteration may be performed on the alternative matrix. The alternative matrix gets approximate to the required separation matrix every time when gradient iteration is performed.

Herein, meeting the iteration stopping condition refers to the xth alternative matrix and the (x−1)th alternative matrix meeting a convergence condition. In an example, that the xth alternative matrix and the (x−1)th alternative matrix meeting the convergence condition refers to a product of the xth alternative matrix and the (x−1)th alternative matrix being in a predetermined numerical range. For example, the predetermined numerical range is (0.9, 1.1).

The operation that gradient iteration is performed based on the updated mapping data of the cth frequency-domain estimation component, the frequency-domain estimation signal, the original noisy signal and the (x−1)th alternative matrix to obtain the xth alternative matrix includes operations as follows.

First derivation is performed on the updated mapping data of the cth frequency-domain estimation component to obtain a first derivative.

Second derivation is performed on the updated mapping data of the cth frequency-domain estimation component to obtain a second derivative.

Gradient iteration is performed based on the first derivative, the second derivative, the frequency-domain estimation signal, the original noisy signal and the (x−1)th alternative matrix to obtain the xth alternative matrix.

For example, gradient iteration is performed based on the first derivative, the second derivative, the frequency-domain estimation signal, the original noisy signal and the (x−1)th alternative matrix to obtain the xth alternative matrix, and the xth alternative matrix may be represented as the following specific formula:

$$W_x(k)=\frac{1}{N}\sum_{n=1}^{N}[G'((q^c)^2)+Y^2(k,n)G''((q^c)^2)]W_{x-1}(k)-\frac{1}{N}\sum_{n=1}^{N}[Y^*(k,n)G'((q^c)^2)X(k,n)],$$

where $W_x$ (k) denotes the xth alternative matrix, $W_{x-1}(k)$ denotes the (x−1)th alternative matrix, n is a positive integer less than or equal to N, N denotes the frame number of audio frames acquired by the microphone, $\phi_n$ (k,m) denotes a weighting coefficient of the nth frequency-domain estimation component, k denotes the frequency point of the band, Y(k,n) denotes the frequency-domain estimation signal at the frequency point k, Y*(k,n) denotes a conjugate transpose of Y(k,m), $G'(q^c)^2)$ denotes the first derivative and $G''((q^c)^2)$ denotes the second derivative.

In a practical application scenario, the above formula meeting the iteration stopping condition may be represented as $|1-\mathrm{tr}\{\mathrm{abs}(W_0(k)W^H(k))\}/N|\leq\xi$, where is a number more than or equal to 0 and less than or equal to ($1/10^{10}$). In an example, $\xi$ is ($1/10^{10}$).

In an example, the operation that the cth separation matrix is determined based on the xth alternative matrix when the xth alternative matrix meets an iteration stopping condition includes operations as follows.

When the xth alternative matrix meets the iteration stopping condition, the xth alternative matrix is acquired.

The cth separation matrix is obtained based on the xth alternative matrix and a conjugate transpose of the xth alternative matrix.

For example, in the practical example, if the xth alternative matrix $W_x(k)$ is acquired, the separation matrix of the cth separation matrix at the frequency point k may be represented as $W(k)=(W_x(k)W_x^H(k))^{-1/2}W_x(k)$, where $W_x^H$, (k) denotes the conjugate transpose of $W_x(k)$.

Accordingly, in the example of the present disclosure, the updated separation matrix may be obtained based on the mapping data of the frequency-domain estimation component of each of frequency-domain sub-bands and each frame of frequency-domain estimation signal and the like, and separation is performed on the original noisy signal based on the updated separation matrix, thereby obtaining better separation performance, and further improving accuracy of the separated audio signal.

At present, in another example, the operation that the separation matrixes are obtained based on the mapping data and the iterative operations of the first frame to the Nth frames of original noisy signals may also be implemented as follows.

Gradient iteration is performed based on the mapping data of the cth frequency-domain estimation component, the frequency-domain estimation signal, the original noisy signal and an (x−1)th alternative matrix, to obtain an xth alternative matrix. A first alternative matrix is a known identity matrix, and x is a positive integer more than or equal to 2.

In response to that the xth alternative matrix meets an iteration stopping condition, the cth separation matrix is determined based on the xth alternative matrix.

The operation that gradient iteration is performed based on the mapping data of the cth frequency-domain estimation component, the frequency-domain estimation signal, the original noisy signal and the (x−1)th alternative matrix to obtain the xth alternative matrix includes operations as follows.

First derivation is performed on the mapping data of the cth frequency-domain estimation component to obtain a first derivative.

Second derivation is performed on the mapping data of the cth frequency-domain estimation component to obtain a second derivative.

Gradient iteration is performed based on the first derivative, the second derivative, the frequency-domain estimation signal, the original noisy signal and the (x−1)th alternative matrix to obtain the xth alternative matrix.

In the example of the present disclosure, the mapping data is non-updated mapping data. In the present application, the separation matrix may also be acquired based on the non-updated mapping data, and signal decomposition is also performed on the mapping data based on the space corresponding to the target feature vector, thereby suppressing the noise signals in various original noisy signals, and improving the quality of the separated audio signal.

In addition, in the example of the present disclosure, the non-updated mapping data is used, and it is unnecessary to perform nonlinear transform on the mapping data according to the logarithmic function, thereby simplifying calculation for the separation matrix to a certain extent.

In an example, the operation that the original noisy signal on the frequency domain is converted into the frequency-domain estimation signals includes an operation that the original noisy signal on the frequency domain is converted into the frequency-domain estimation signals based on a known identity matrix.

In another example, the operation that the original noisy signal on the frequency domain is converted into the frequency-domain estimation signals includes an operation that the original noisy signal on the frequency domain is converted into the frequency-domain estimation signals based on an alternative matrix.

Herein, the alternative matrix may be the first alternative matrix to the (x−1)th alternative matrix in the abovementioned example.

For example, the frequency point data $Y(k,n)=W(k)X(k,n)$ of the frequency point k in the nth frame is acquired, where X(k,n) denotes the nth frame of original noisy signal on the frequency domain, and the separation matrix W (k) may be the first alternative matrix to the (x−1)th alternative matrix in the abovementioned example. For example, W(k) is a known identity matrix or an alternative matrix obtained by (x−1)th iteration.

In the example of the present disclosure, the known identity matrix may be used as a separation matrix during first iteration. For the subsequent iteration, the alternative matrix obtained by the previous iteration may be used as a separation matrix for the subsequent iteration, so that a basis is provided for acquisition of the separation matrix.

In some examples, the operation that the audio signals of the sounds respectively produced by the at least two sound sources are obtained based on the separation matrixes and the original noisy signals includes operations as follows.

For each of the frequency-domain estimation signals, separation is performed on the nth frame of original noisy signal corresponding to the frequency-domain estimation signal based on the first separation matrix to the Cth separation matrix, to obtain audio signals of different sound sources in the nth frame of original noisy signal corresponding to the frequency-domain estimation signal, where n is a positive integer less than N.

The audio signals of the pth sound source in the nth frame of original noisy signal corresponding to the frequency-domain estimation signals are combined to obtain an nth frame of audio signal of the pth sound source, where p is a positive integer less than or equal to P, and P is the number of the sound sources.

For example, two microphones, i.e., a microphone 1 and a microphone 2 are included, two sound sources, i.e., a sound source 1 and a sound source 2 are included. Each of the microphone 1 and the microphone 2 acquires three frames of original noisy signals. For the first frame of original noisy signal, separation matrixes respectively corresponding to a first frequency-domain estimation signal to a Cth frequency-domain estimation signal are calculated. For example, the separation matrix of the first frequency-domain estimation signal is a first separation matrix, the separation matrix of the second frequency-domain estimation signal is a second separation matrix, and so on, and the separation matrix of the Cth frequency-domain estimation signal is a Cth separation matrix. Then, an audio signal of the first frequency-domain estimation signal is acquired based on a noise signal corresponding to the first frequency-domain estimation signal and the first separation matrix, an audio signal of the second frequency-domain estimation signal is obtained based on a noise signal corresponding to the second frequency-domain estimation signal and the second separation matrix, and so on, and an audio signal of the Cth frequency-domain estimation signal is obtained based on a noise signal corresponding to the Cth frequency-domain estimation signal and the Cth separation matrix. The audio signal of the first frequency-domain estimation signal, the audio signal of the second frequency-domain estimation signal and the audio signal of the third frequency-domain estimation signal are combined to obtain first frame audio signals of the microphone 1 and the microphone 2.

It can be understood that other frame audio signals may also be acquired based on a method similar to the above example, which is not described repeatedly herein.

In the example of the present disclosure, for each frame, the audio signals of frequency-domain estimation signals in the frame may be obtained based on the noise signals and separation matrixes corresponding to the frequency-domain estimation signals in the frame, and then the audio signals of the frequency-domain estimation signals in the frame are combined to obtain a first frame audio signal.

In the example of the present disclosure, after the audio signal of the frequency-domain estimation signal is obtained, time-domain transform may further be performed on the audio signal to obtain the audio signal of each sound source on the time domain.

For example, time-domain transform may be performed on the frequency-domain signal based on Inverse Fast Fourier Transform (IFFT). Alternatively, the frequency-domain signal may be transformed into a time-domain signal based on Inverse Short-Time Fourier Transform (ISTFT). Alternatively, time-domain transform may also be performed on the frequency-domain signal based on other Inverse Fourier transform.

In some examples, the method further includes an operation that the first frame audio signal to the Nth frame audio signal of the pth sound source are combined in time chorological to obtain the audio signal of the pth sound source in the N frames of original noisy signals.

For example, two microphones, i.e., a microphone 1 and a microphone 2 are included, two sound sources, i.e., a sound source 1 and a sound source 2 are included. Each of the microphone 1 and the microphone 2 acquires three frames of original noisy signals, the three frames include a first frame, a second frame and a third frame in chronological order. The first frame audio signal, the second frame audio signal and the third frame audio signal of the sound source 1 are obtained by calculation, and the audio signal of the sound source 1 is obtained by combining the first frame audio signal, the second frame audio signal and the third frame audio signal of the sound source 1 in chronological order. The first frame audio signal, the second frame audio signal and the third frame audio signal of the sound source 2 are obtained, and the audio signal of the sound source 2 is obtained by combining the first frame audio signal, the second frame audio signal and the third frame audio signal of the sound source 2 in chronological order.

In the example of the present disclosure, for each sound source, the audio signals of all audio frames of the sound source may be combined, to obtain the complete audio signal of the sound source.

Figure 2:
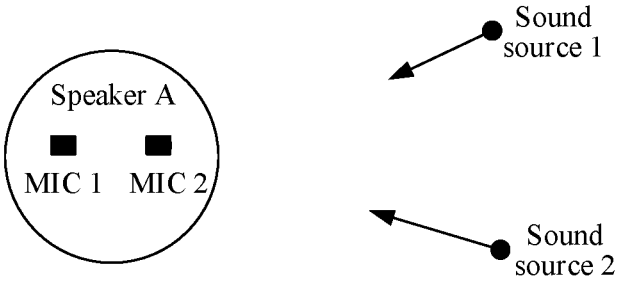
FIG. 2 is a block diagram of an application scenario of a method for processing an audio signal according to an example.

For helping the abovementioned examples of the present disclosure to be understood, descriptions are made herein with the following example. As shown in FIG. 2, an application scenario of a method for processing an audio signal is disclosed. A terminal includes a speaker A, the speaker A includes two microphones, i.e., a microphone 1 and a microphone 2 respectively, and two sound sources, i.e., a sound source 1 and a sound source 2 are included. Signals sent by the sound source 1 and the sound source 2 may be acquired by the microphone 1 and the microphone 2. The signals of the two sound sources are mixed in each microphone.

Figure 3:
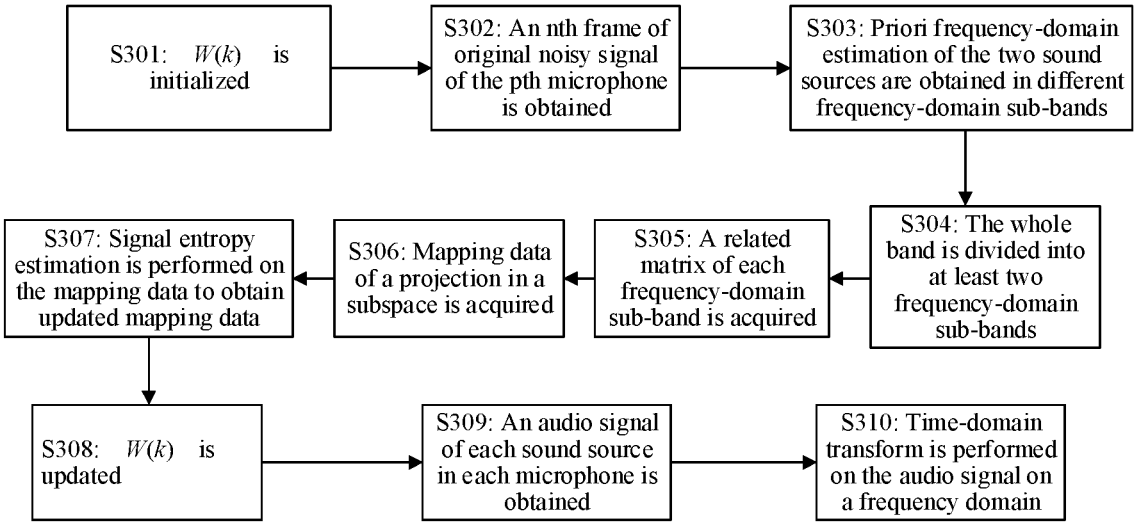
FIG. 3 is a flow chart of a method for processing an audio signal according to an example.

FIG. 3 is a flow chart of a method for processing an audio signal according to an example. In the method for processing an audio signal, as illustrated in FIG. 2, sound sources include a sound source 1 and a sound source 2, and microphones include a microphone 1 and a microphone 2. Based on the method for processing an audio signal, the sound source 1 and the sound source 2 are recovered from signals of the microphone 1 and the microphone 2. As shown in FIG. 3, the method includes the following operations.

If a system frame length is Nfft, a frequency point is K=Nfft/2+1.

In S301, W (k) is initialized.

Specifically, a separation matrix of each frequency point is initialized.

$$W(k) = [w_1(k), w_2(k)]^H = \begin{bmatrix} 1 & 0 \\ 0 & 1 \end{bmatrix}, \text{where } \begin{bmatrix} 1 & 0 \\ 0 & 1 \end{bmatrix}$$

denotes an identity matrix, k denotes a frequency-domain estimation signal, and k=1, L, K.

In S302, an nth frame of original noisy signal of the pth microphone is obtained.

Specifically, $x_p''(m)$ is windowed, to obtain a frequency-domain signal $X_p(k,n)=STFT(x_p''(m))$ of Nfft points, where m denotes the number of points selected for Fourier transform, STFT is short-time Fourier transform, and $x_p''(m)$ denotes an nth frame of time-domain signal of the pth microphone. Herein, the time-domain signal is an original noisy signal.

Herein, the microphone 1 is represented in a case of p=1, and the microphone 2 is represented in a case of p=2.

Then, a measured signal of $X_p(k,n)$ is represented as $X(k,n)=[X_1(k,n), X_2(k,n)]^T$, where $X_1(k,n)$ and $X_2(k,n)$ denote original noisy signals of the sound source 1 and the sound source 2 on a frequency domain respectively, and $[X_1(k,n), X_2(k,n)]^T$ denotes a transposed matrix of $[X_1(k,n), X_2(k,n)]$.

In S303, priori frequency-domain estimation of the two sound sources are obtained in different frequency-domain sub-bands.

Specifically, the priori frequency-domain estimation of the signals of the two sound sources is set as $Y(k,n)=[Y_1(k,n), Y_2(k,n)]^T$, where $Y_1(k,n)$ and $Y_2(k,n)$ denote estimated values of the sound source 1 and the sound source 2 at a frequency-domain estimation signal (k,n) respectively.

Separation is performed on a measured matrix X (k,n) through the separation matrix W (k) to obtain Y(k,n)=W(k) 'X(k,n), where W'(k) denotes a separation matrix (i.e., an alternative matrix) obtained by previous iteration.

Then, a priori frequency-domain estimation of the pth sound source in the mth frame is represented as $\overline{Y}_p(n)=[Y_p(1, n), \ldots Y_p(K,n)]^T$.

Herein, the priori frequency-domain estimation is the frequency-domain estimation signal in the abovementioned example.

In S304, the whole band is divided into at least two frequency-domain sub-bands.

Specifically, the whole band is divided into C frequency-domain sub-bands.

A frequency-domain estimation signal $\overline{Y}_p^c(n)=[Y_p(l_c, n), \ldots Y_p(h_c,n)]^T$ of the cth frequency-domain sub-band is acquired, where n=1, L, N, $l_n$ and $h_n$ denote a first frequency point and last frequency point of the nth frequency-domain sub-band, $l_n<h_{n-1}$, and c=2, L, C. In this way, it is ensured partial frequency overlapping between adjacent frequency-domain sub-bands, $N_n=h_n-l_n+1$ represents the number of frequency points of the cth frequency-domain sub-band.

In S305, a related matrix of each frequency-domain sub-band is acquired.

Specifically, the related matrix $$\sum_{p}^{c} = \frac{1}{N}\sum_{n=1}^{N} \overline{Y}_p^c(n)\overline{Y}_p^c(n)^H,$$

of the cth frequency-domain sub-band is calculated, where $Y_p^c(n)^H$ denotes a conjugate matrix of $Y_p^c(n)$ and p=1,2.

In S306, mapping data of projection in a subspace is acquired.

Specifically, feature decomposition is performed on $\Sigma_p^c$ of the cth frequency-domain sub-band to obtain a maximum feature value $\lambda_p^c$ and a target feature vector $v_p^c$ corresponding to the maximum feature value, and mapping data $q_p^c=\alpha(v_p^c)^T\overline{Y}_p^c(n)$ of a frequency-domain estimation component of the cth frequency-domain sub-band mapped into a subspace corresponding to the target feature vector is obtained based on $v_p^c$, where $(v_p^c)^T$ is a transposed matrix of $(v_p^c)$.

In S307, signal entropy estimation is performed on the mapping data to obtain updated mapping data.

It can be understood herein that performing signal entropy estimation on the mapping data is implemented by performing nonlinear transform on the mapping data according to a logarithmic function.

Specifically, nonlinear mapping is performed on the mapping data corresponding to the cth frequency-domain sub-band according to the logarithmic function to acquire updated mapping data $G(q_p^c)=\log_{10}(q_p^c)$ corresponding to the cth frequency-domain sub-band.

First derivation is performed on the updated mapping data $G(q_p^c)$ to obtain a first derivative $G'((q_p^c)^2)=-1/(q_p^c)$.

Second derivation is performed on the updated mapping data $G(q_p^c)$ to obtain a second derivative $G''((q_p^c)^2)=-1/(q_p^c)^4$.

In S308, W(k) is updated.

Specifically, an alternative matrix $$W_x(k) = \frac{1}{N}\sum_{n=1}^{N}[G'((q^c)^2) + Y^2(k,n)G''((q^c)^2)]W_{x-1}(k) - \frac{1}{N}\sum_{n=1}^{N}[Y^*(k,n)G'((q^c)^2)X(k,n)]$$

for present iteration is obtained according to the first derivative, the second derivative, the first frequency-domain estimation signal to the Nth frame frequency-domain estimation signal, the first frame original noisy signal to the Nth frame original noisy signal and an alternative matrix for previous iteration, where $W_{x-1}(k)$ denotes the alternative matrix for previous iteration, $W_x(k)$ is denotes the acquired alternative matrix for present iteration, and Y*(k,n) is a conjugate transpose of Y(k,n).

Herein, in a case of $|1-\mathrm{tr}\{\mathrm{abs}(W_x(k)W_{x-1}^H(k))\}/N|\leq\xi$, it indicates that the obtained $W_{x-1}(k)$ has met a convergence condition. If it is determined that $W_{x-1}(k)$ meets the convergence condition, W (k) is updated to ensure that a separation matrix for the point k is $W(k)=(W_x(k)W_x^H(k))^{-1/2}W_x(k)$.

In an example, ξ is a value less than or equal to ($1/10^6$).

Herein, if the related matrix of the frequency-domain sub-band is the related matrix of the cth frequency-domain sub-band, the point k is in the cth frequency-domain sub-band.

In the example, gradient iteration is performed according to a sequence from high frequency to low frequency. Therefore, the separation matrix of each frequency of each frequency-domain sub-band may be updated.

Exemplarily, pseudo codes for sequentially acquiring the separation matrix of each frequency-domain estimation signal are provided below.

Specifically, converged[m][k] indicates a converged state of the kth frequency point of the cth frequency-domain sub-band, c=1, L, C and k=1, L, K. In a case of converged [m][k]=1, it indicates that the frequency point has been converged, otherwise it is not converged.

```
For c = C : 1;
For iter = 1 : MaxIter;
For k = l_c : h_c;
Y(k, n) = W(k)X(k, n);
END;
```

$$\sum_{p}^{c} = \frac{1}{N}\sum_{n=1}^{N}\overline{Y}_p^c(n)\overline{Y}_p^c(n)^H;$$

$$q_p^c = \alpha(v_p^c)^T\overline{Y}_p^c(n);$$

```
For k = l_c : h_c;
If(converged[c][k] == 1);
Continue;
END;
```

$$w_x(k) = \frac{1}{N}\sum_{n=1}^{N}[G'((q^c)^2) + Y^2(k,n)G''((q^c)^2)]w_{x-1}(k) - \frac{1}{N}\sum_{n=1}^{N}[Y^*(k,n)G'((q^c)^2)X(k,n)];$$

$$\text{If}|1 - tr\{\mathrm{abs}(W_x(k)W_{x-1}^H(k))\}/N| \leq \xi;$$

```
converged[c][k] = 1;
END;
```

$$W(k) = (W_x(k)W_x^H(k))^{-1/2}W_x(k);$$

```
END;
END;
END.
```

In the example, ξ denotes a threshold for determining convergence of W(k), and ξ is ($1/10^6$).

In S309, an audio signal of each sound source in each microphone is obtained.

Specifically, $Y_p(k,m)=W_p(k)X_p(k,m)$ is obtained based on the updated separation matrix W (k), where p=1, 2, $Y(k,n)=[Y_1(k,n),Y_2(k,n)]^T$ $W_p(k)=[W_1(k\ n), W_2(k,n)]$ and $X_p(k,m)=[X_1(k,n),X_1(k,n)]^T$.

In S310, time-domain transform is performed on the audio signal on a frequency domain.

Time-domain transform is performed on the audio signal on the frequency domain to obtain an audio signal on a time domain.

ISTFT and overlapping-addition are performed on $\overline{Y}_p(n)=[Y_p(1, n), \ldots (K,n)]^T$ to obtain an estimated third audio signal $s_p''(m)=\mathrm{ISTFT}(\overline{Y}_p(n))$ on the time domain.

In the example of the present disclosure, the mapping data of the maximum target feature vector projected into the corresponding subspace may be obtained based on a product of a transposed matrix of the target feature vector corresponding to the maximum feature value of each frequency-domain estimation component and the frequency-domain estimation component. In this way, according to the example of the present disclosure, the original noisy signals are decomposed based on the subspace corresponding to the maximum signal to noise ratio, thereby suppressing a noise signal in each original noisy signal, improving separation performance, and further improving quality of the separated audio signal.

In addition, compared with the other implementations that signals of sound sources are separated by use of a multi-microphone-based beamforming technology, the method for processing an audio signal provided in the example of the present disclosure can realize high-accurate separation for the audio signals of the sounds produced by the sound sources without considering the positions of these microphones. Moreover, only two microphones are used in the example of the present disclosure, thereby greatly reducing the number of microphones and reducing hardware cost of the terminal, compared with the other implementations that voice quality is improved by use of a beamforming technology based on at least more than three microphones.

Figure 4:
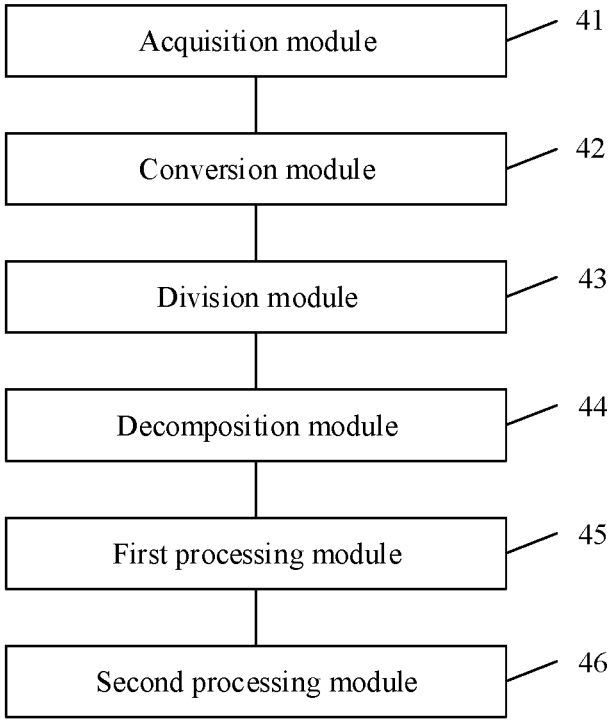
FIG. 4 is a schematic diagram of a device for processing an audio signal according to an example.

FIG. 4 is a block diagram of a device for processing an audio signal according to an example. Referring to FIG. 4, the device includes an acquisition module 41, a conversion module 42, a division module 43, a decomposition module 44, a first processing module 45 and a second processing module 46.

The acquisition module 41 is configured to acquire audio signals sent by at least two sound sources through at least two microphones, to obtain multiple frames of original noisy signals of each of the at least two microphones on a time domain.

The conversion module 42 is configured to, for each frame on the time domain, acquire frequency-domain estimation signals of each of the at least two sound sources according to the respective original noisy signals of the at least two microphones.

The division module 43 is configured to, for each of the at least two sound sources, divide the frequency-domain estimation signals into multiple frequency-domain estimation components on a frequency domain. Each frequency-domain estimation component corresponds to a frequency-domain sub-band and includes multiple pieces of frequency point data.

The decomposition module 44 is configured to, for each sound source, perform feature decomposition on a related matrix of each of the frequency-domain estimation components to obtain a target feature vector corresponding to the frequency-domain estimation component.

The first processing module 45 is configured to, for each sound source, obtain a separation matrix of each frequency point based on the target feature vectors and the frequency-domain estimation signals of the sound source.

The second processing module 46 is configured to obtain the audio signals of sounds produced respectively by the at least two sound sources based on the separation matrixes and the original noisy signals.

In some examples, the acquisition module 41 is configured to, for each sound source, obtain a first matrix of the cth frequency-domain estimation component based on a product of the cth frequency-domain estimation component and a conjugate transpose of the cth frequency-domain estimation component; acquire the related matrix of the cth frequency-domain estimation component based on the first matrixes of the cth frequency-domain estimation component in the first frame to the Nth frame, N being the number of frames of the original noisy signals, c being a positive integer less than or equal to C and C being the number of the frequency-domain sub-bands.

In some examples, the first processing module 45 is configured to, for each sound source, obtain mapping data of the cth frequency-domain estimation component mapped into a preset space based on a product of a transposed matrix of the target feature vector of the cth frequency-domain estimation component and the cth frequency-domain estimation component; and obtain the separation matrixes based on the mapping data and iterative operations of the first frame original noisy signal to the Nth frame original noisy signal.

In some examples, the first processing module 45 is further configured to perform nonlinear transform on the mapping data according to a logarithmic function to obtain updated mapping data.

In some examples, the first processing module 45 is configured to perform gradient iteration based on the updated mapping data of the cth frequency-domain estimation component, the frequency-domain estimation signal, the original noisy signal and an (x−1)th alternative matrix to obtain an xth alternative matrix. A first alternative matrix is a known identity matrix and x is a positive integer more than or equal to 2, and when the xth alternative matrix meets an iteration stopping condition, determine the cth separation matrix based on the xth alternative matrix.

In some examples, the first processing module 45 is configured to perform first derivation on the updated mapping data of the cth frequency-domain estimation component to obtain a first derivative, perform second derivation on the updated mapping data of the cth frequency-domain estimation component to obtain a second derivative and perform gradient iteration based on the first derivative, the second derivative, the frequency-domain estimation signal, the original noisy signal and the (x−1)th alternative matrix to obtain the xth alternative matrix.

In some examples, the second processing module 46 is configured to perform separation on the nth frame of original noisy signal corresponding to each of the frequency-domain estimation signals based on the first separation matrix to the Cth separation matrix, to obtain audio signals of different sound sources in the nth frame of original noisy signal corresponding to the frequency-domain estimation signal, where n being a positive integer less than N; and combine the audio signals of the pth sound source in the nth frame of original noisy signal corresponding to the frequency-domain estimation signals to obtain an nth frame audio signal of the pth sound source, p being a positive integer less than or equal to P and P being the number of the sound sources.

In some examples, the second processing module 46 is further configured to combine first frame audio signal to Nth frame audio signal of the pth sound source in chronological order to obtain the audio signal of the pth sound source in the N frames of original noisy signals.

With respect to the device in the above example, the manners of performing operations by individual modules therein have been described in detail in the method example, which will not be elaborated herein.

The examples of the present disclosure also provide a terminal, which includes a processor; and a memory configured to store an instruction executable for a processor.

The processor is configured to execute the executable instruction to implement the method for processing an audio signal of any example of the present disclosure.

The memory may include various types of storage mediums, and the storage medium is a non-transitory computer storage medium and may store information in a communication device after the communication device powers down.

The processor may be connected with the memory through a bus and the like, and is configured to read an executable program stored in the memory to implement, for example, at least one of the methods illustrated in FIG. 1 and FIG. 3.

The examples of the present disclosure also provide a computer-readable storage medium, which stores an executable program. The executable program is executed by a processor to implement the method for processing an audio signal according to any example of the present disclosure, for implementing, for example, at least one of the methods illustrated in FIG. 1 and FIG. 3.

With respect to the device in the above example, the manners of performing operations by individual modules therein have been described in detail in the method example, which will not be elaborated herein.

Figure 5:
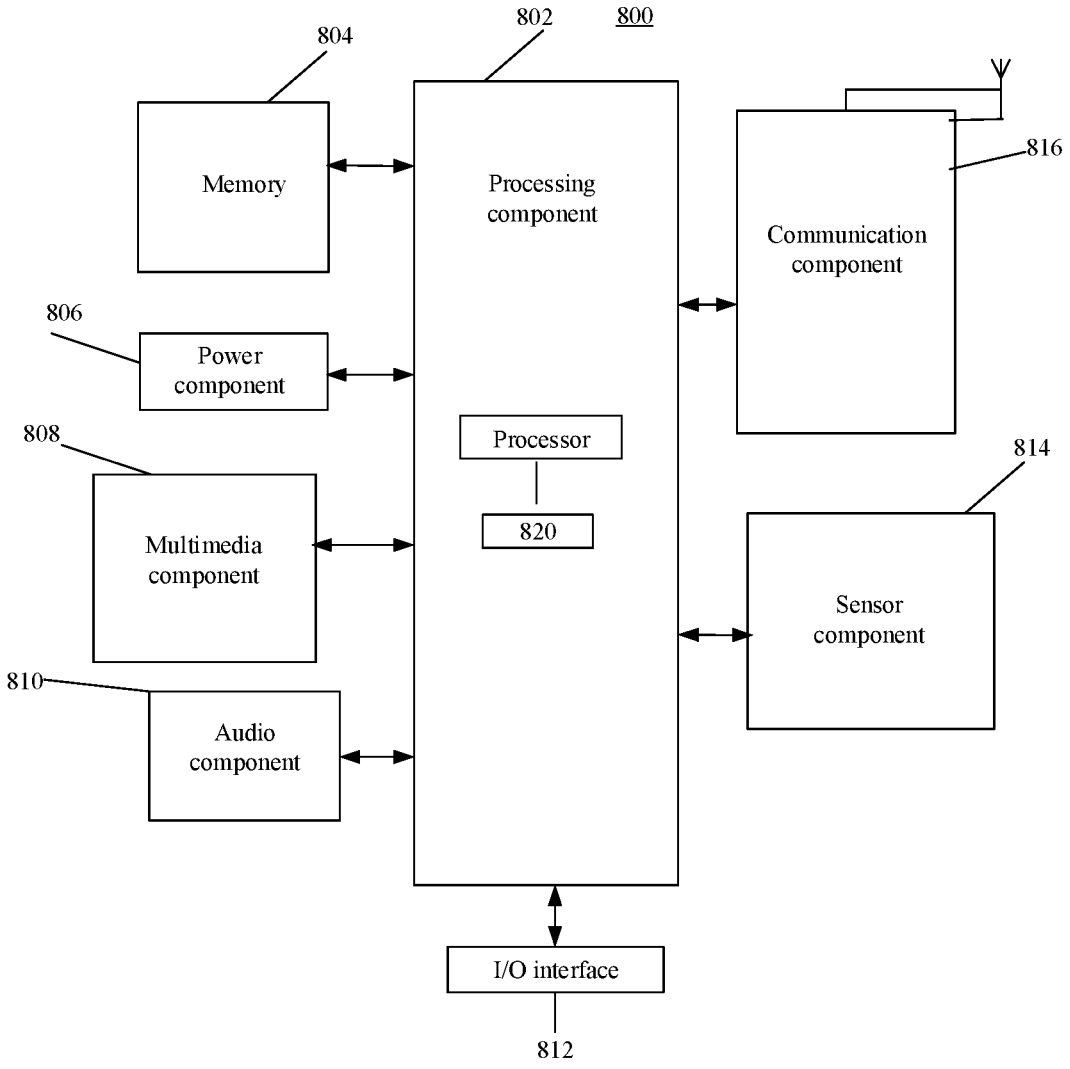
FIG. 5 is a block diagram of a terminal according to an example.

FIG. 5 is a block diagram of a terminal 800 according to an example. For example, the terminal 800 may be a mobile phone, a computer, a digital broadcast terminal, a messaging device, a gaming console, a tablet, a medical device, exercise equipment, a personal digital assistant and the like.

Referring to FIG. 5, the terminal 800 may include one or more of the following components: a processing component 802, a memory 804, a power component 806, a multimedia component 808, an audio component 810, an Input/Output (I/O) interface 812, a sensor component 814, and a communication component 816.

The processing component 802 typically controls overall operations of the terminal 800, such as the operations associated with display, telephone calls, data communications, camera operations, and recording operations. The processing component 802 may include one or more processors 820 to execute instructions to perform all or part of the steps in the abovementioned method. Moreover, the processing component 802 may include one or more modules which facilitate interaction between the processing component 802 and the other components. For instance, the processing component 802 may include a multimedia module to facilitate interaction between the multimedia component 808 and the processing component 802.

The memory 804 is configured to store various types of data to support the operation of the device 800. Examples of such data include instructions for any application programs or methods operated on the terminal 800, contact data, phonebook data, messages, pictures, video, etc. The memory 804 may be implemented by any type of volatile or non-volatile memory devices, or a combination thereof, such as an Static Random Access Memory (SRAM), an Electrically Erasable Programmable Read-Only Memory (EEPROM), an Erasable Programmable Read-Only Memory (EPROM), a Programmable Read-Only Memory (PROM), a Read-Only Memory (ROM), a magnetic memory, a flash memory, and a magnetic or optical disk.

The power component 806 provides power for various components of the terminal 800. The power component 806 may include a power management system, one or more power supplies, and other components associated with generation, management and distribution of power for the terminal 800.

The multimedia component 808 includes a screen providing an output interface between the terminal 800 and a user. In some examples, the screen may include a Liquid Crystal Display (LCD) and a Touch Panel (TP). If the screen includes the TP, the screen may be implemented as a touch screen to receive an input signal from the user. The TP includes one or more touch sensors to sense touches, swipes and gestures on the TP. The touch sensors may not only sense a boundary of a touch or swipe action but also detect a duration and pressure associated with the touch or swipe action. In some examples, the multimedia component 808 includes a front camera and/or a rear camera. The front camera and/or the rear camera may receive external multimedia data when the device 800 is in an operation mode, such as a photographing mode or a video mode. Each of the front camera and the rear camera may be a fixed optical lens system or have focusing and optical zooming capabilities.

The audio component 810 is configured to output and/or input an audio signal. For example, the audio component 810 includes a microphone (MIC), and the MIC is configured to receive an external audio signal when the terminal 800 is in the operation mode, such as a call mode, a recording mode and a voice recognition mode. The received audio signal may further be stored in the memory 804 or sent through the communication component 816. In some examples, the audio component 810 further includes a speaker configured to output the audio signal.

The I/O interface 812 provides an interface between the processing component 802 and a peripheral interface module, and the peripheral interface module may be a keyboard, a click wheel, a button and the like. The button may include, but be not limited to: a home button, a volume button, a starting button and a locking button.

The sensor component 814 includes one or more sensors configured to provide status assessment in various aspects for the terminal 800. For instance, the sensor component 814 may detect an on/off status of the device 800 and relative positioning of components, such as a display and small keyboard of the terminal 800, and the sensor component 814 may further detect a change in a position of the terminal 800 or a component of the terminal 800, presence or absence of contact between the user and the terminal 800, orientation or acceleration/deceleration of the terminal 800 and a change in temperature of the terminal 800. The sensor component 814 may include a proximity sensor configured to detect presence of an object nearby without any physical contact. The sensor component 814 may also include a light sensor, such as a Complementary Metal Oxide Semiconductor (CMOS) or Charge Coupled Device (CCD) image sensor, configured for use in an imaging application. In some examples, the sensor component 814 may also include an acceleration sensor, a gyroscope sensor, a magnetic sensor, a pressure sensor or a temperature sensor.

The communication component 816 is configured to facilitate wired or wireless communication between the terminal 800 and another device. The terminal 800 may access a communication-standard-based wireless network, such as a Wireless Fidelity (WiFi) network, a 2nd-Generation (2G) or 3rd-Generation (3G) network or a combination thereof. In an example, the communication component 816 receives a broadcast signal or broadcast associated information from an external broadcast management system through a broadcast channel. In an example, the communication component 816 further includes a Near Field Communication (NFC) module to facilitate short-range communication. For example, the NFC module may be implemented based on a Radio Frequency Identification (RFID) technology, an Infrared Data Association (IrDA) technology, an Ultra-Wide Band (UWB) technology, a Bluetooth (BT) technology and another technology.

In an example, the terminal 800 may be implemented by one or more Application Specific Integrated Circuits (ASICs), Digital Signal Processors (DSPs), Digital Signal Processing Devices (DSPDs), Programmable Logic Devices (PLDs), Field Programmable Gate Arrays (FPGAs), controllers, micro-controllers, microprocessors or other electronic components, and is configured to execute the abovementioned method.

In an example, a non-transitory computer-readable storage medium including an instruction is further provided, such as the memory 804 including an instruction, and the instruction may be executed by the processor 820 of the terminal 800 to implement the abovementioned method. For example, the non-transitory computer-readable storage medium may be an ROM, a Random Access Memory (RAM), a Compact Disc Read-Only Memory (CD-ROM), a magnetic tape, a floppy disc, an optical data storage device and the like.

The present disclosure may include dedicated hardware implementations such as application specific integrated circuits, programmable logic arrays and other hardware devices. The hardware implementations can be constructed to implement one or more of the methods described herein. Applications that may include the apparatus and systems of various examples can broadly include a variety of electronic and computing systems. One or more examples described herein may implement functions using two or more specific interconnected hardware modules or devices with related control and data signals that can be communicated between and through the modules, or as portions of an application-specific integrated circuit. Accordingly, the system disclosed may encompass software, firmware, and hardware implementations. The terms "module," "sub-module," "circuit," "sub-circuit," "circuitry," "sub-circuitry," "unit," or "sub-unit" may include memory (shared, dedicated, or group) that stores code or instructions that can be executed by one or more processors. The module refers herein may include one or more circuit with or without stored code or instructions. The module or circuit may include one or more components that are connected.

Other implementation solutions of the present disclosure will be apparent to those skilled in the art from consideration of the specification and practice of the present disclosure. This application is intended to cover any variations, uses, or adaptations of the present disclosure conforming to the general principles thereof and including such departures from the present disclosure as come within known or customary practice in the art. It is intended that the specification and examples are only exemplary only.

It will be appreciated that the present disclosure is not limited to the exact construction that has been described above and illustrated in the accompanying drawings, and that various modifications and changes may be made without departing from the scope thereof

What is claimed is:

1. A method for processing an audio signal, comprising:

acquiring, through at least two microphones of a terminal, audio signals sent by at least two sound sources, to obtain a plurality of frames of original noisy signals of each of the at least two microphones on a time domain;

for each frame of the original noisy signals on the time domain, acquiring frequency-domain estimation signals of each of the at least two sound sources according to the original noisy signals of the at least two microphones;

for each of the at least two sound sources, dividing the frequency-domain estimation signals into a plurality of frequency-domain estimation components based on a frequency domain, wherein each frequency-domain estimation component corresponds to a frequency-domain sub-band and comprises a plurality of pieces of frequency point data;

for each of the at least two sound sources, performing feature decomposition on a related matrix of each of the frequency-domain estimation components to obtain a target feature vector corresponding to the frequency-domain estimation component;

for each of the at least two sound sources, obtaining a separation matrix of each of frequency points based on the target feature vectors and the frequency-domain estimation signals of the sound source;

obtaining the audio signals of sounds produced by the at least two sound sources based on the separation matrixes and the original noisy signals;

for each of the at least two sound sources, obtaining a first matrix of a cth frequency-domain estimation component based on a product of the cth frequency-domain estimation component and a conjugate transpose of the cth frequency-domain estimation component; and acquiring the related matrix of the cth frequency-domain estimation component based on first matrixes of the cth frequency-domain estimation component according to a first frame original noisy signal to a Nth frame original noisy signal, wherein N is a number of frames of the original noisy signals, c is a positive integer less than or equal to C and C is the number of the frequency-domain sub-bands;

wherein for each of the at least two sound sources, obtaining the separation matrixes of the frequency points based on the target feature vectors and the frequency-domain estimation signals of the sound source further comprises:

for each of the at least two sound sources, obtaining mapping data of the cth frequency-domain estimation component mapped into a preset space based on a product of a transposed matrix of the target feature vector of the cth frequency-domain estimation component and the cth frequency-domain estimation component; and obtaining the separation matrixes based on the mapping data and iterative operations of the first frame original noisy signal to the Nth frame original noisy signal.

2. The method of claim 1, further comprising:

performing nonlinear transform on the mapping data according to a logarithmic function to obtain updated mapping data.

3. The method of claim 2, wherein obtaining the separation matrixes based on the mapping data and the iterative operations of the first frame original noisy signal to the Nth frame original noisy signal comprises:

performing gradient iteration based on the updated mapping data of the cth frequency-domain estimation component, the frequency-domain estimation signal, the original noisy signal and an (x−1)th alternative matrix to obtain an xth alternative matrix, wherein a first alternative matrix is a known identity matrix and x is a positive integer more than or equal to 2; and determining a cth separation matrix based on the xth alternative matrix when the xth alternative matrix meets an iteration stopping condition.

4. The method of claim 3, wherein performing the gradient iteration based on the updated mapping data of the cth frequency-domain estimation component, the frequency-domain estimation signal, the original noisy signal and the (x−1)th alternative matrix to obtain the xth alternative matrix comprises:

performing first derivation on the updated mapping data of the cth frequency-domain estimation component to obtain a first derivative;

performing second derivation on the updated mapping data of the cth frequency-domain estimation component to obtain a second derivative; and performing the gradient iteration based on the first derivative, the second derivative, the frequency-domain estimation signal, the original noisy signal and the (x−1)th alternative matrix to obtain the xth alternative matrix.

5. The method of claim 1, wherein obtaining the audio signals of sounds produced by the at least two sound sources based on the separation matrixes and the original noisy signals comprises:

for each of the frequency-domain estimation signals, performing separation on a nth frame original noisy signal corresponding to the frequency-domain estimation signal based on a first separation matrix to a Cth separation matrix, to obtain audio signals of different sound sources in the nth frame original noisy signal corresponding to the frequency-domain estimation signal, wherein n is a positive integer less than N; and combining the audio signals of a pth sound source in the nth frame original noisy signal corresponding to all frequency-domain estimation signals to obtain a nth frame audio signal of the pth sound source, wherein p is a positive integer less than or equal to P and P is the number of the sound sources.

6. The method of claim 5, further comprising:

combining a first frame audio signal to a Nth frame audio signal of the pth sound source in chronological order to obtain N frames of original noisy signals comprising the audio signal of the pth sound source.

7. A device for processing an audio signal, comprising:

a processor; and a memory configured to store instructions executable by the processor, wherein the processor is configured to acquire, through at least two microphones, audio signals sent by at least two sound sources, to obtain a plurality of frames of original noisy signals of each of the at least two microphones on a time domain;

for each frame of the original noisy signals on the time domain, acquire frequency-domain estimation signals of each of the at least two sound sources according to the original noisy signals of the at least two microphones;

for each of the at least two sound sources, divide the frequency-domain estimation signals into a plurality of frequency-domain estimation components based on a frequency domain, wherein each frequency-domain estimation component corresponds to a frequency-domain sub-band and comprises a plurality of pieces of frequency point data;

for each of the at least two sound sources, perform feature decomposition on a related matrix of each of the frequency-domain estimation components to obtain a target feature vector corresponding to the frequency-domain estimation component;

for each of the at least two sound sources, obtain a separation matrix of each of frequency points based on the target feature vectors and the frequency-domain estimation signals of the sound source;

obtain the audio signals of sounds produced by the at least two sound sources based on the separation matrixes and the original noisy signals;

for each of the at least two sound sources, obtain a first matrix of a cth frequency-domain estimation component based on a product of the cth frequency-domain estimation component and a conjugate transpose of the cth frequency-domain estimation component;

acquire the related matrix of the cth frequency-domain estimation component based on the first matrixes of the cth frequency-domain estimation component according to a first frame original noisy signal to a Nth frame original noisy signal, wherein N is a number of frames of the original noisy signals, c is a positive integer less than or equal to C and C is a number of the frequency-domain sub-bands;

for each of the at least two sound sources, obtain mapping data of the cth frequency-domain estimation component mapped into a preset space based on a product of a transposed matrix of the target feature vector of the cth frequency-domain estimation component and the cth frequency-domain estimation component; and obtain the separation matrixes based on the mapping data and iterative operations of the first frame original noisy signal to the Nth frame original noisy signal.

8. The device of claim 7, wherein the processor is further configured to perform nonlinear transform on the mapping data according to a logarithmic function to obtain updated mapping data.

9. The device of claim 8, wherein the processor is further configured to:

perform gradient iteration based on the updated mapping data of the cth frequency-domain estimation component, the frequency-domain estimation signal, the original noisy signal and an (x−1)th alternative matrix to obtain an xth alternative matrix, wherein a first alternative matrix is a known identity matrix and x is a positive integer more than or equal to 2; and determine a cth separation matrix based on the xth alternative matrix when the xth alternative matrix meets an iteration stopping condition.

10. The device of claim 9, wherein the processor is further configured to:

perform first derivation on the updated mapping data of the cth frequency-domain estimation component to obtain a first derivative;

perform second derivation on the updated mapping data of the cth frequency-domain estimation component to obtain a second derivative; and perform the gradient iteration based on the first derivative, the second derivative, the frequency-domain estimation signal, the original noisy signal and the (x−1)th alternative matrix to obtain the xth alternative matrix.

11. The device of claim 7, wherein the processor is further configured to:

for each of the frequency-domain estimation signals, perform separation on the nth frame original noisy signal corresponding to the frequency-domain estimation signal based on a first separation matrix to a Cth separation matrix, to obtain audio signals of different sound sources in the nth frame original noisy signal corresponding to the frequency-domain estimation signal, wherein n is a positive integer less than N; and combine the audio signals of a pth sound source in the nth frame original noisy signal corresponding to all frequency-domain estimation signals to obtain an nth frame audio signal of the pth sound source, wherein p is a positive integer less than or equal to P and P is the number of the sound sources.

12. The device of claim 11, wherein the processor is further configured to:

combine a first frame audio signal to a Nth frame audio signal of the pth sound source in chronological order to obtain N frames of original noisy signals comprising the audio signal of the pth sound source.

13. A non-transitory computer-readable storage medium storing an executable program, wherein the executable program is executed by a processor to implement:

acquiring, through at least two microphones, audio signals sent by at least two sound sources, to obtain a plurality of frames of original noisy signals of each of the at least two microphones on a time domain;

for each frame of the original noisy signals on the time domain, acquiring frequency-domain estimation signals of each of the at least two sound sources according to the original noisy signals of the at least two microphones;

for each of the at least two sound sources, dividing the frequency-domain estimation signals into a plurality of frequency-domain estimation components based on a frequency domain, wherein each frequency-domain estimation component corresponds to a frequency-domain sub-band and comprises a plurality of pieces of frequency point data;

for each of the at least two sound sources, performing feature decomposition on a related matrix of each of the frequency-domain estimation components to obtain a target feature vector corresponding to the frequency-domain estimation component;

for each of the at least two sound sources, obtaining a separation matrix of each of frequency points based on the target feature vectors and the frequency-domain estimation signals of the sound source;

obtaining the audio signals of sounds produced by the at least two sound sources based on the separation matrixes and the original noisy signals;

for each of the at least two sound sources, obtaining a first matrix of a cth frequency-domain estimation component based on a product of the cth frequency-domain estimation component and a conjugate transpose of the cth frequency-domain estimation component; and acquiring the related matrix of the cth frequency-domain estimation component based on first matrixes of the cth frequency-domain estimation component according to a first frame original noisy signal to a Nth frame original noisy signal, wherein N is a number of frames of the original noisy signals, c is a positive integer less than or equal to C and C is the number of the frequency-domain sub-bands, wherein the executable program, executed by the processor to implement, for each of the at least two sound sources, obtaining the separation matrixes of the frequency points based on the target feature vectors and the frequency-domain estimation signals of the sound source, is executed by the processor to further implement:

for each of the at least two sound sources, obtaining mapping data of the cth frequency-domain estimation component mapped into a preset space based on a product of a transposed matrix of the target feature vector of the cth frequency-domain estimation component and the cth frequency-domain estimation component; and obtaining the separation matrixes based on the mapping data and iterative operations of the first frame original noisy signal to the Nth frame original noisy signal.

14. The non-transitory computer-readable storage medium of claim 13, wherein the executable program is executed by the processor to further implement:

performing nonlinear transform on the mapping data according to a logarithmic function to obtain updated mapping data.

* * * * *